US011062630B2

(12) United States Patent
Wu

(10) Patent No.: US 11,062,630 B2
(45) Date of Patent: Jul. 13, 2021

(54) DISPLAY PANEL

(71) Applicant: Wuhan China Star Optoelectronics Semiconductor Display Technology Co., Ltd., Hubei (CN)

(72) Inventor: Shaojing Wu, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 85 days.

(21) Appl. No.: 16/615,289

(22) PCT Filed: May 9, 2019

(86) PCT No.: PCT/CN2019/086255
§ 371 (c)(1),
(2) Date: Nov. 20, 2019

(87) PCT Pub. No.: WO2020/191869
PCT Pub. Date: Oct. 1, 2020

(65) Prior Publication Data

US 2020/0410913 A1 Dec. 31, 2020

(30) Foreign Application Priority Data

Mar. 28, 2019 (CN) ..... 201910242944.2

(51) Int. Cl.
*G09G 3/00* (2006.01)

(52) U.S. Cl.
CPC ..... *G09G 3/006* (2013.01); *G09G 2300/0426* (2013.01); *G09G 2330/12* (2013.01)

(58) Field of Classification Search
CPC ..... G09G 3/006; G09G 2300/0426; G09G 2330/12
USPC ..... 324/500, 537, 76.11
See application file for complete search history.

(56) References Cited

U.S. PATENT DOCUMENTS

2018/0158741 A1 6/2018 Kim et al.
2019/0181362 A1 6/2019 Tian et al.
2020/0028520 A1 1/2020 Jones et al.
2020/0203236 A1* 6/2020 Lee ..... H01L 22/34
(Continued)

FOREIGN PATENT DOCUMENTS

CN 106992263 A 7/2017
CN 107255655 A 10/2017
(Continued)

*Primary Examiner* — Giovanni Astacio-Oquendo
(74) *Attorney, Agent, or Firm* — Hamre, Schumann, Mueller & Larson, P.C.

(57) ABSTRACT

The present invention provides a display panel, including a display area, a crack stop area on a periphery of the display area, and a cutting channel disposed on a periphery of the crack stop area; wherein the display panel further includes a monitoring circuit, and the monitoring circuit is used for monitoring cracks generated in the cutting channel when the cutting is proceeded; and wherein a metal signal line is disposed in the crack stop area surrounding the display area and is electrically connected to the monitoring circuit, the metal signal line is formed by electrically connecting two metal layers, the metal signal line is used for blocking the cracks generated extend toward the display area.

20 Claims, 6 Drawing Sheets

(56) References Cited

U.S. PATENT DOCUMENTS

| | | | | |
|---|---|---|---|---|
| 2020/0265783 | A1* | 8/2020 | Lee | H01L 27/3276 |
| 2020/0379595 | A1* | 12/2020 | Kim | G09G 3/32 |

FOREIGN PATENT DOCUMENTS

| | | | |
|---|---|---|---|
| CN | 107863357 | A | 3/2018 |
| CN | 107910296 | A | 4/2018 |
| CN | 108154800 | A | 6/2018 |
| CN | 207458945 | U | 6/2018 |
| CN | 108717957 | A | 10/2018 |
| CN | 108922462 | A | 11/2018 |
| CN | 208111041 | U | 11/2018 |
| CN | 109166459 | A | 1/2019 |
| CN | 109192072 | A | 1/2019 |
| CN | 109256464 | A | 1/2019 |
| CN | 208422917 | U | 1/2019 |
| CN | 109493772 | A | 3/2019 |

* cited by examiner

DISPLAY PANEL

FIELD OF INVENTION

The present invention relates to a display technology, and more specifically, relates to a display panel.

BACKGROUND OF INVENTION

Flat plate displays (FPD) have gradually become a required tool for people's work and learning. In manufacturing processes of the FPD, regarding cutting a display panel from a glass evaporated functional layers, the current display panel industry has multiple cutting processes before obtaining the final display panel. Cracks are easy to be generated in a vicinity of a cutting channel during cutting processes. If the cracks are extended into the inside of the display panel (effective display area), the functional film layers could be destroyed, thereby affecting the display quality. Therefore, a crack stop area for protection is designed on the inner side of the cutting channel to prevent the extension of the cracks from happening. Nowadays, designs of the crack stop area mainly based on designing inorganic layer grooves and are problematic because of the poor crack stop effect. Furthermore, a monitoring circuit portion is designed to monitor the yield, which is not conducive to design a narrow frame display panel.

Therefore, the conventional design has problems and is in urgent need for improvement.

SUMMARY OF INVENTION

The present invention provides a display panel to solve the crack damage inside the display panel during cutting the display panel and to solve the issue that cracks can't be monitored timely.

For solving the above problems, the present invention provides technical solutions as follows:

The present invention provides a display panel, including a display area and a crack stop area surrounding the display area, a cutting channel disposed on a periphery of the crack stop area; wherein the display panel includes a monitoring circuit, and the monitoring circuit is used for monitoring cracks generated in the cutting channel when the cutting is proceeded; and wherein a metal signal line is disposed in the crack stop area surrounding the display area and is electrically connected to the monitoring circuit; a shape of an orthogonal projection of the metal signal line on the display panel is curved, the metal signal line includes a first metal layer and a second metal layer electrically connected to the first metal layer through a plurality of through holes, the first metal layer and/or the second metal layer are used for blocking the cracks generated extend toward the display area during cutting the display panel.

In a display panel of the present invention, the first metal layer includes a plurality of first metal blocks spaced at an interval, the second metal layer includes a plurality of second metal blocks spaced at an interval, and both the first metal blocks and the second metal blocks are disposed surrounding the display area and along the crack stop area.

In a display panel of the present invention, the first metal blocks of two adjacent columns/rows are staggered, and the interval between the two adjacent first metal blocks is less than a length of the first metal block; the second metal blocks are distributed in an array.

In a display panel of the present invention, each of the second metal blocks is connected to two adjacent and staggered the first metal blocks; the second metal blocks in the same column/row form a metal signal line by being electrically connected to the first metal blocks of two adjacent columns/rows through the through holes.

In a display panel of the present invention, both shapes of the first metal blocks and the second metal blocks are rectangular, and the first metal blocks and the second metal blocks are arranged in a stripe distribution or a block distribution.

In a display panel of the present invention, the first metal blocks of two adjacent columns/rows are staggered, and the interval between the two adjacent first metal blocks is less than a length of the first metal block; and wherein the second metal blocks of two adjacent columns/rows are staggered, and the interval between two adjacent second metal blocks is less than a length of the second metal block.

In a display panel of the present invention, the second metal block is disposed at the corresponding interval between the two adjacent first metal blocks to make the second metal blocks in a column/row connect the corresponding first metal blocks in a column/row through the through holes and form the metal signal line.

In a display panel of the present invention, shapes of both the first metal blocks and the second metal blocks are U-shaped, and the directions of the U-shaped openings of the first metal blocks and the second metal blocks are opposite to make an orthogonal projection shape of the metal signal line on the display panel is curved.

In a display panel of the present invention, the metal signal line is electrically connected to the monitoring circuit through a metal wire trace, the metal signal line is used for receiving a constant voltage high/low level signal; the monitoring circuit is used for monitoring the constant voltage high/low level signal through the metal signal line, wherein monitoring results of the constant voltage high/low level signal from the monitoring circuit correspond to determine whether a crack is anomaly occurred in the cutting channel.

In a display panel of the present invention, during the cutting process of the display panel, no crack is anomaly occurred in the cutting channel when the monitoring circuit detects the constant voltage high/low level signal continuously; and wherein otherwise, the crack is anomaly occurred in the cutting channel.

For solving the above problems, the present invention further provides a display panel, including a display area and a crack stop area surrounding the display area, a cutting channel disposed on a periphery of the crack stop area; wherein the display panel includes a monitoring circuit, and the monitoring circuit is used for monitoring cracks generated in the cutting channel when the cutting is proceeded; and wherein a metal signal line is disposed in the crack stop area surrounding the display area and is electrically connected to the monitoring circuit, the metal signal line includes a first metal layer and a second metal layer electrically connected to the first metal layer through a plurality of through holes, the first metal layer and/or the second metal layer are used for blocking the cracks generated extend toward the display area during cutting the display panel.

In a display panel of the present invention, the first metal layer includes a plurality of first metal blocks spaced at an interval, the second metal layer includes a plurality of second metal blocks spaced at an interval, and both the first metal blocks and the second metal blocks are disposed surrounding the display area and along the crack stop area.

In a display panel of the present invention, the first metal blocks of two adjacent columns/rows are staggered, and the interval between the two adjacent first metal blocks is less than a length of the first metal block; the second metal blocks are distributed in an array.

In a display panel of the present invention, each of the second metal blocks is connected to two adjacent and staggered the first metal blocks; the second metal blocks in the same column/row form a metal signal line by being electrically connected to the first metal blocks of two adjacent columns/rows through the through holes.

In a display panel of the present invention, both shapes of the first metal blocks and the second metal blocks are rectangular, and the first metal blocks and the second metal blocks are arranged in a stripe distribution or a block distribution.

In a display panel of the present invention, the first metal blocks of two adjacent columns/rows are staggered, and the interval between the two adjacent first metal blocks is less than a length of the first metal block; and wherein the second metal blocks of two adjacent columns/rows are staggered, and the interval between two adjacent second metal blocks is less than a length of the second metal block.

In a display panel of the present invention, the second metal block is disposed at the corresponding interval between the two adjacent first metal blocks to make the second metal blocks in a column/row connect the corresponding first metal blocks in a column/row through the through holes and form the metal signal line.

In a display panel of the present invention, shapes of both the first metal blocks and the second metal blocks are U-shaped, and the directions of the U-shaped openings of the first metal blocks and the second metal blocks are opposite.

In a display panel of the present invention, the metal signal line is electrically connected to the monitoring circuit through a metal wire trace, the metal signal line is used for receiving a constant voltage high/low level signal, the monitoring circuit is used for monitoring the constant voltage high/low level signal through the metal signal line, wherein monitoring results of the constant voltage high/low level signal from the monitoring circuit correspond to determine whether a crack is anomaly occurred in the cutting channel.

In a display panel of the present invention, during the cutting process of the display panel, no crack is anomaly occurred in the cutting channel when the monitoring circuit detects the constant voltage high/low level signal continuously; and wherein otherwise, the crack is anomaly occurred in the cutting channel.

Advantageous effects of the present invention: compared with the conventional display panel, in a display panel of the present invention, by disposing a crack stop area on the inner side of a cutting channel of the display panel and surrounding a display area, preparing a metal signal line formed with two metal layers in the crack stop area, and designing a structure and an arrangement of the two metal layers, the metal signal line can not only block cracks generated extend toward the display area during cutting the display panel but also monitor anomaly cracks in the crack stop area timely by connecting a monitoring circuit of the display panel; furthermore, the present invention is conducive to achieve narrowing the frame of the display panel.

DESCRIPTION OF DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which figures those skilled in the art can derive further figures without making any inventive efforts.

DETAILED DESCRIPTION OF PREFERRED EMBODIMENTS

Figure 1:
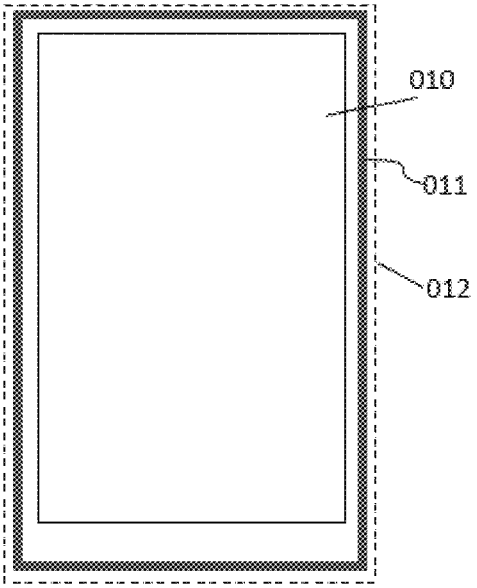
FIG. 1 is a schematic top plan view of a display panel according to an embodiment of the present invention.

The following embodiments are referring to the accompanying drawings for exemplifying specific performable embodiments of the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto. In the drawings, structure-like elements are labeled with like reference numerals.

The present embodiment can solve technical problems of a conventional display panel: cracks damage inside the display panel during a cutting process and to solve the issue that cracks can't be monitored timely.

FIG. 1 is a schematic top plan view of a display panel according to an embodiment of the present invention. The display panel includes a display area 010, a cutting channel 012 surrounding the display area 010, and a crack stop area 011 between the display area 010 and the cutting channel 012. The crack stop area 011 is disposed surrounding the display area 010. During a cutting process of the display panel, a cutting knife cuts the display panel along the cutting channel 012. The crack stop area 011 is used for blocking the cracks generated on an edge of the display panel extend toward the display area 010 during the cutting process.

Figure 3:
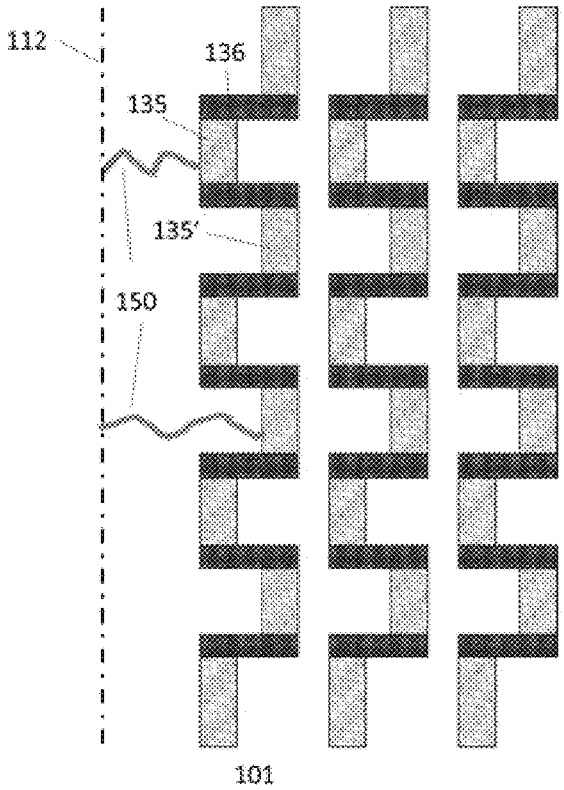
FIG. 3 is a partial schematic diagram of a metal signal line of a crack stop area according to a first embodiment of the present invention.
Figure 7:
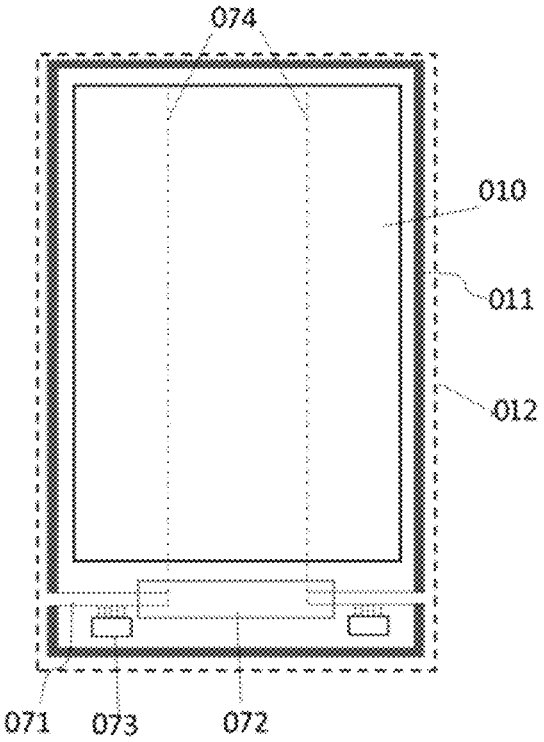
FIG. 7 is a schematic plan view of a crack monitor of a display panel according to an embodiment of the present invention.

The display panel further includes a monitoring circuit 072 as shown in FIG. 7, the monitoring circuit is used for monitoring cracks generated in the cutting channel 012 during cutting the cutting channel 012. A metal signal line 101 as shown in FIG. 3 is disposed in the crack stop area 011 surrounding the display area 010. The metal signal line is formed by an electrically connection between a first metal layer and a second metal layer through a plurality of through holes of an insulating layer. The first metal layer and/or the second metal layer in the crack stop area 011 are used for blocking the cracks generated extend toward the display area 010 during cutting the display panel.

Figure 2:
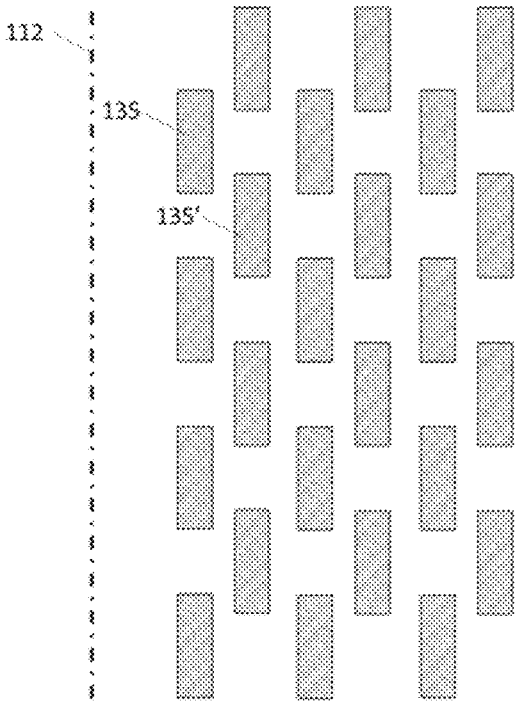
FIG. 2 is a partial schematic diagram of a first metal layer of a crack stop area according to a first embodiment of the present invention.

Referring to FIG. 2 and FIG. 3, the first metal layer includes a plurality of independent and staggered first metal blocks 135 and first metal blocks 135'. The first metal blocks 135 in the same column/row are adjacent and staggered to the first metal blocks 135' in the same column/row. The interval between the two adjacent first metal blocks 135 (135') is less than a length of the first metal block 135' (135). The first metal blocks 135 (135') are disposed surrounding the display area 010 and along the crack stop area 011.

The second metal layer includes a plurality of independent second metal blocks 136 distributed in an array. The second metal blocks 136 are disposed surrounding the display area 010 and along the crack stop area 011.

One of the second metal blocks 136 is connected to the adjacent and staggered first metal blocks through the through holes; namely, both ends of one of the second metal blocks 136 are electrically connected to one of the first metal blocks 135 and one of the first metal blocks 135', respectively. The second metal blocks 136 in a column/row are connected to the adjacent and corresponding first metal blocks 135 in a column/row and first metal blocks 135' in a column/row through the through holes and form the metal signal line 101. One or more metal signal lines 101 can be disposed in the crack stop area 011.

In the present embodiment, both shapes of the first metal blocks 135 (135') and the second metal blocks 136 are rectangular, but are not limited thereto. The first metal blocks 135 (135') and the second metal blocks 136 are arranged in a stripe distribution or a block distribution. A shape of an orthogonal projection of the metal signal line 101 on the display panel is curved.

If cracks 150 are generated in the display panel during cutting the cutting channel 112, the cracks 150 will extend from the cutting channel 112 toward the inner side. Some of the cracks 150 extend until encountering the first metal blocks 135, and some of the cracks 150 extend until encountering the first metal blocks 135'. Since the first metal blocks 135 and the first metal blocks 135' are staggered, the extension paths of the cracks 150 are all stopped, which effectively prevents the extension of the cracks 150. Note that, the first metal blocks 135 and the first metal blocks 135' aren't essentially different but only staggered.

Figure 4:
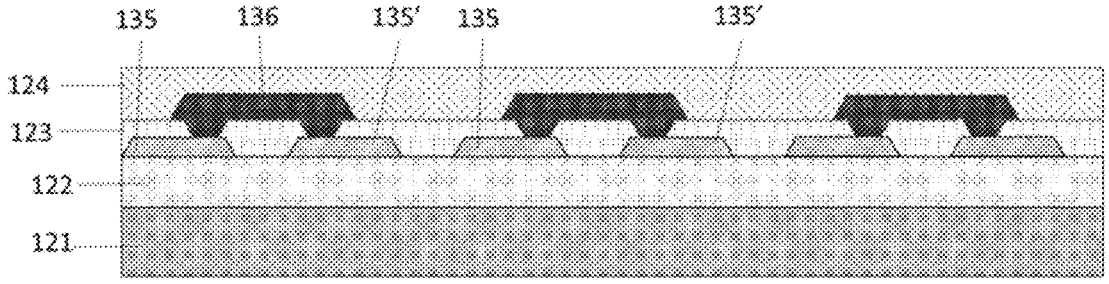
FIG. 4 is a schematic cross-sectional film layer of a crack stop area perpendicularly to a metal signal line in FIG. 3.
Figure 5:
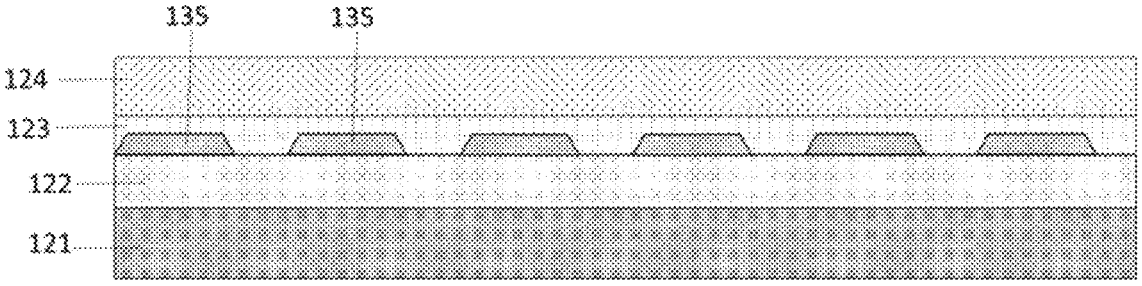
FIG. 5 is a schematic cross-sectional film layer of a crack stop area parallel to a metal signal line in FIG. 3.
Figure 6:
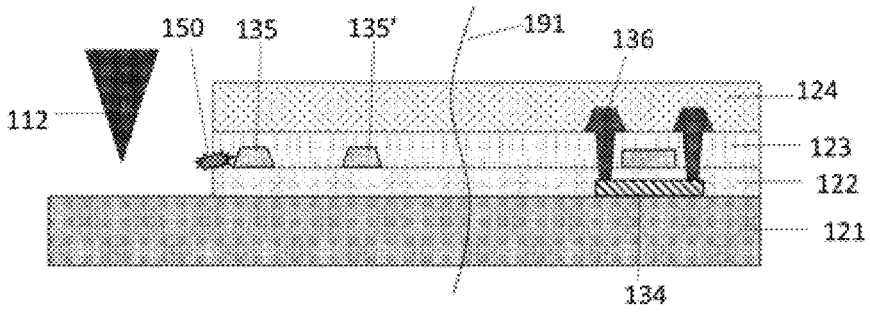
FIG. 6 is a schematic sectional view of a display panel according to a first embodiment of the present invention.

Referring to FIG. 4-FIG. 6, FIG. 4 is a schematic cross-sectional film layer of a crack stop area perpendicularly to a metal signal line in FIG. 3. The display panel includes a substrate 121, and the substrate 121 includes a flexible layer, a buffer layer, etc. A first insulating layer 122 is disposed on the substrate 121, and the first insulating layer 122 can be a first gate insulating layer. A first metal layer is disposed on the first insulating layer 122, the patterned first metal layer forms the first metal blocks 135 (135') spaced at an interval. The first metal layer can be a first gate metal layer. A second insulating layer 123 is disposed on the first metal layer. The second insulating layer 123 can be a second gate metal layer (if the second metal layer is a second gate metal layer) or an interlayer insulating layer (if the second metal layer is a source drain metal layer). Here the second metal layer be a source drain metal layer will be described as an example. A plurality of through holes exposing portions of the first metal layer are disposed on the second insulating layer 123. The second metal layer is disposed on the second insulating layer 123 and forms the second metal blocks 136 after patterning. A planarization layer 124 is disposed on the second metal blocks 136.

The first metal blocks 135 and the first metal blocks 135' are adjacent and staggered. The second metal blocks 136 are respectively connected to the first metal blocks 135 and the first metal blocks 135' perpendicularly to the metal signal line 101 through the through holes disposed on the second insulating layer 123. The second metal blocks 136 are alternately connected to the first metal blocks 135 and the first metal blocks 135' to form the metal signal line 101.

FIG. 5 is a schematic cross-sectional film layer of a crack stop area parallel to a metal signal line in FIG. 3. FIG. 5 is a cross-sectional schematic view of the first metal blocks 135 in the same column/row. A cross-sectional schematic view of the first metal blocks 135' is similar but only staggered to the cross-sectional schematic view of the first metal blocks 135.

FIG. 6 is a schematic sectional view of a display panel according to a first embodiment of the present invention. The left side of a boundary 191 is the crack stop area 011, and the right side of the boundary 191 is a functional area of the display panel [including a GOA (Gate on Array) area and the display area 010]. In the display area, a semiconductor active layer 134 is disposed on the substrate 121; gate electrodes are formed after patterning the first metal layer; and source drain electrodes are formed after patterning the second metal layer. When the cracks 150 are generated during the display panel being cut along the cutting channel 112, the first metal blocks 135 and the first metal blocks 135' block the cracks 150 extend toward the display area. Since the first metal blocks 135 and the first metal blocks 135' are staggered, the extension paths of the cracks 150 greatly increase. The present design greatly reduces the probability that the cracks 150 extend toward the display area.

FIG. 7 is a schematic plan view of a crack monitor of a display panel according to an embodiment of the present invention. The different metal signal lines surround the display area 010 in the crack stop area 011 and are connected to be one signal line and a crack monitoring circuit. A monitoring circuit 072 is disposed on one side of the display area 010 and between the display area 010 and the crack stop area 011. The metal signal line in the crack stop area 011 is electrically connected to the monitoring circuit 072 through a metal wire trace 071. The metal signal line receives a constant voltage high/low level signal 073 through the metal wire trace 071. The monitoring circuit 072 further monitors the constant voltage high/low level signal 073 through the metal signal line, wherein monitoring results of the constant voltage high/low level signal 073 from the monitoring circuit 072 correspond to determine whether a crack is anomaly occurred in the cutting channel 012.

During the cutting process of the display panel, no crack is anomaly occurred in the cutting channel 012 when the monitoring circuit 072 detects the constant voltage high/low level signal continuously; and wherein otherwise, the crack is anomaly occurred in the cutting channel 012.

Particularly, under normal circumstances or the condition that the cracks is not serious, the metal signal line surrounding the display area 010 doesn't break and can transmit the constant voltage high/low level signal 073, the monitoring circuit 072 detects the constant voltage high/low level signal 073, and no abnormality is occurred in a lighting test of the display panel. When the metal signal line breaks due to serious cracks, the metal signal line can't normally transmit the constant voltage high/low level signal 073, and the monitoring circuit 072 can't detect the constant voltage high/low level signal 073. In a particular lighting test mode (e.g., red test screen), a screen shows an abnormality in the connecting position between the monitoring circuit 072 and the metal wire trace 071. The display area 010 shows bright/dark lines 074 as shown in FIG. 7, which determines an occurrence of serious cracks and achieves the purpose of monitoring cracks.

By the above-described design, the display panel of the present invention can not only block cracks generated extend toward the display area during the cutting process but also monitor anomaly cracks in the crack stop area timely; furthermore, the monitoring circuit of the present invention is simple, which is conducive to achieve narrowing the frame of the display panel.

Figure 8:
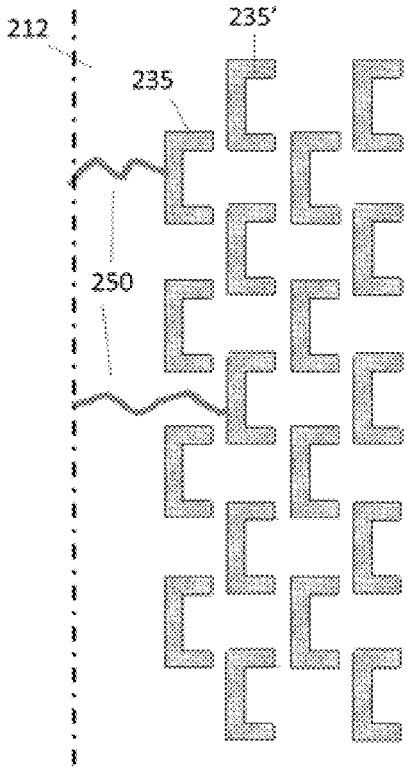
FIG. 8 is a partial schematic diagram of a first metal layer of a crack stop area of a display panel according to a second embodiment of the present invention.
Figure 9:
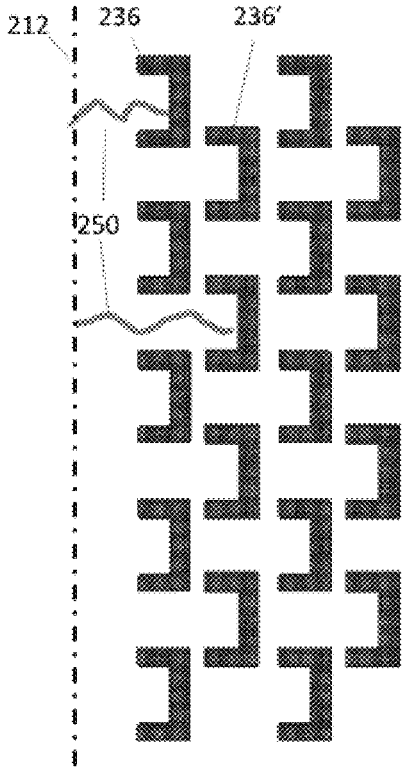
FIG. 9 is a partial schematic diagram of a second metal layer of a crack stop area of a display panel according to a second embodiment of the present invention.
Figure 10:
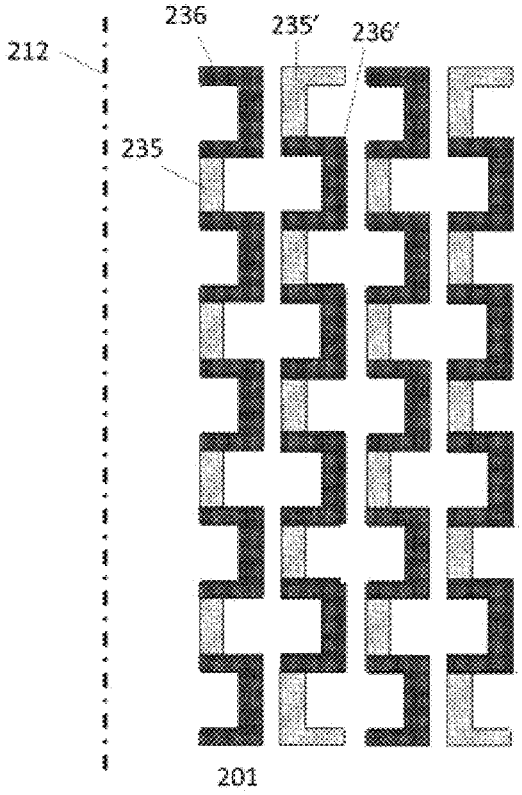
FIG. 10 is a partial schematic diagram of a metal signal line of a crack stop area of a display panel according to a second embodiment of the present invention.

Referring to FIG. 8-FIG. 10, FIG. 8 is a partial schematic diagram of a first metal layer of a crack stop area of a display panel according to a second embodiment of the present invention. In the present embodiment, the first metal layer includes a plurality of independent and staggered first metal blocks 235 and first metal blocks 235'. The first metal blocks 235 in the same column/row are adjacent and staggered to the first metal blocks 235' in the same column/row. The interval between the two adjacent first metal blocks 235 (235') is less than a length of the first metal block 235' (235).

Referring to FIG. 9, the second metal layer includes a plurality of independent and staggered second metal blocks 236 and second metal blocks 236'. The second metal blocks 236 in the same column/row are adjacent and staggered to the second metal blocks 236' in the same column/row. The interval between the two adjacent second metal blocks 236 (236') is less than a length of the second metal block 236' (236).

In conjunction with the FIG. 1, both the first metal blocks 235 (235') and the second metal blocks 236 (236') are disposed surrounding the display area 010 and along the crack stop area 011.

Referring to FIG. 10, the second metal block 236 (236') is disposed at the corresponding interval between the two adjacent first metal blocks 235 (235') to make the second metal blocks 236 (236') in a column/row connect the corresponding first metal blocks 235 (235') in a column/row through the through holes and form the metal signal line 201.

Shapes of both the first metal blocks 235 (235') and the second metal blocks 236 (236') are U-shaped, but are not limited thereto. The directions of the U-shaped openings of the first metal blocks 235 (235') and the second metal blocks 236 (236') are opposite to make an orthogonal projection shape of the metal signal line 201 on the display panel is curved.

When cracks 250 are generated in a vicinity of a cutting channel 212, the cracks 250 extend toward the inner side of the display panel. The cracks 250 extend until encountering the first metal blocks 235 (235'). Since the first metal blocks 235 and the first metal blocks 235' are staggered, the extension paths of the cracks 250 greatly increase, which greatly reduces the crack generation probability of the inner of the display area. Similarly, the cracks 250 extend until encountering the second metal blocks 236 (236'). Since the second metal blocks 236 and the second metal blocks 236' are staggered, the extension paths of the cracks 250 greatly increase. Through the through holes disposed on the interlayer insulating layer, the second metal blocks 236 connect the two adjacent first metal blocks 235, and the second metal blocks 236' connect the two adjacent first metal blocks 235'. Then at least two metal signal line 201 are formed. Note that, the first metal blocks 235 and the first metal blocks 235' aren't essentially different but only staggered, and the second metal blocks 236 and the second metal blocks 236' aren't essentially different but only staggered.

By using the present design, the interval between the adjacent first metal blocks 235 and first metal blocks 235' and the interval between the adjacent first metal blocks 236 and first metal blocks 236' become less, which increases the probability of stopping the extension of the cracks 250; furthermore, due to using the U-shaped structure design, extending toward other directions is difficult for the cracks 250 under such a complicated topography, which increases the probability of stopping the extension of the cracks 250 again.

Figure 11:
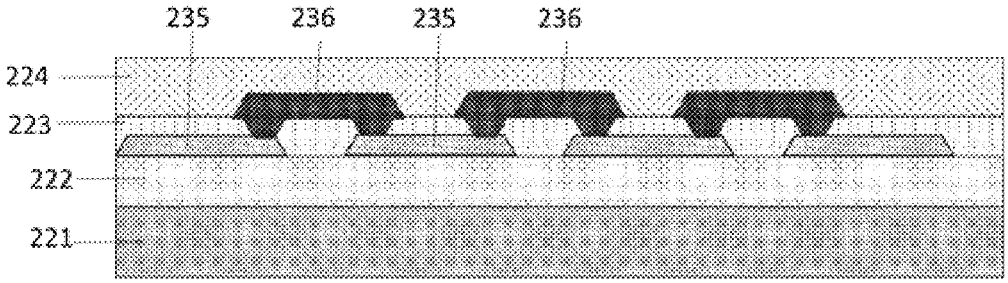
FIG. 11 is a schematic cross-sectional film layer of a crack stop area parallel to a metal signal line in FIG. 10.
Figure 12:
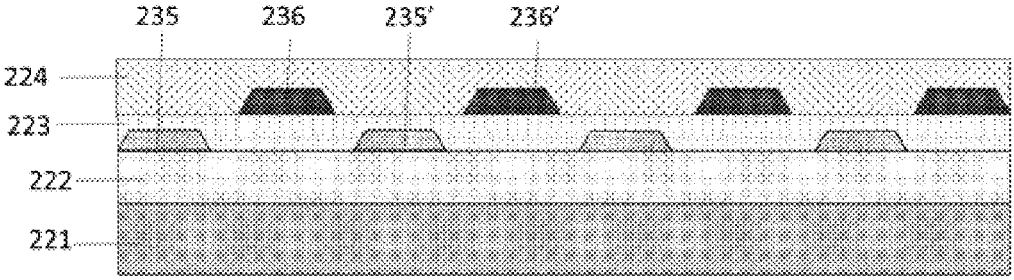
FIG. 12 is a schematic cross-sectional film layer of a crack stop area perpendicularly to a metal signal line in FIG. 10.
Figure 13:
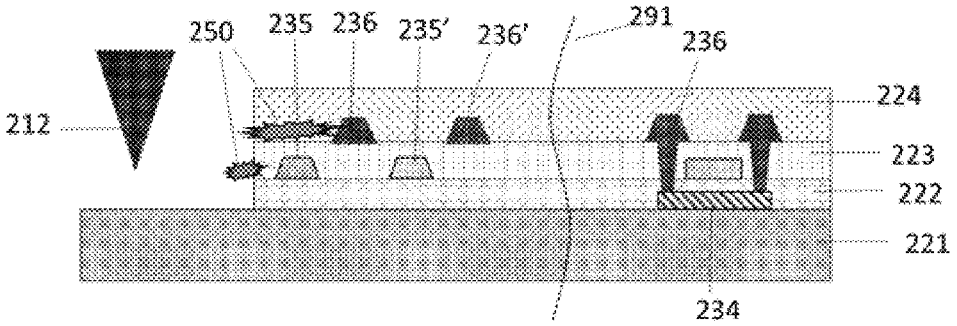
FIG. 13 is a schematic sectional view of a display panel according to a second embodiment of the present invention.

Referring to FIG. 11-FIG. 13, the display panel includes a substrate 221, and the substrate 221 includes a flexible layer, a buffer layer, etc. A first insulating layer 222, a first metal layer 235, 235', a second insulating layer 223, a second metal layer 236, 236', and a planarization layer 224 are disposed on the substrate 221.

The first metal blocks 235 and the first metal blocks 235' are adjacent and staggered. The second metal blocks 236 and the second metal blocks 236' are adjacent and staggered. Through the through holes disposed on the second insulating layer 223, the second metal blocks 236 are connected to the two adjacent first metal blocks 235 parallel to the metal signal line 201 to form the metal signal line 201; the second metal blocks 236' are connected to the two adjacent first metal blocks 235' parallel to the metal signal line 201 to form the metal signal line 201.

As shown in FIG. 12, in the direction perpendicularly to the metal signal line 201, the first metal blocks 235 (235') and the second metal blocks 236 (236') are staggered. The first metal blocks 235 are adjacent and staggered to the first metal blocks 235', and the second metal blocks 236 are adjacent and staggered to the second metal blocks 236'.

FIG. 13 is a schematic sectional view of a display panel according to a second embodiment of the present invention. The left side of a boundary 291 is the crack stop area 011, and the right side of the boundary 291 is a functional area of the display panel [including a GOA (Gate on Array) area and the display area 010]. In the display area, a semiconductor active layer 234 is disposed on the substrate 221; gate electrodes are formed after patterning the first metal layer; and source drain electrodes are formed after patterning the second metal layer. When the cracks 250 are generated during the display panel being cut along the cutting channel 212, the first metal blocks 235 and the first metal blocks 235' block the cracks 250 extend toward the display area. Meanwhile, the second metal blocks 236 and the second metal blocks 236' also block the cracks 250 extend toward the display area. Since the first metal blocks 235 and the first metal blocks 235' are staggered and the second metal blocks 236 and the second metal blocks 236' are staggered, the extension paths of the cracks 250 greatly increase, which greatly reduces the probability that the cracks 250 extend toward the display area.

A crack monitoring method of a display panel according to a second embodiment of the present invention is same as the crack monitoring method according to the above first embodiment. The embodiment can be found in the description of the above first embodiment, not further described herein.

Figure 14:
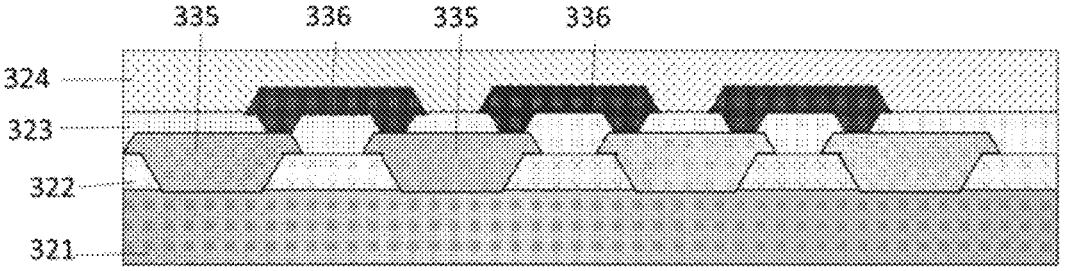
FIG. 14 is a schematic cross-sectional film layer of a crack stop area of a display panel parallel to a metal signal line according to a third embodiment of the present invention.
Figure 15:
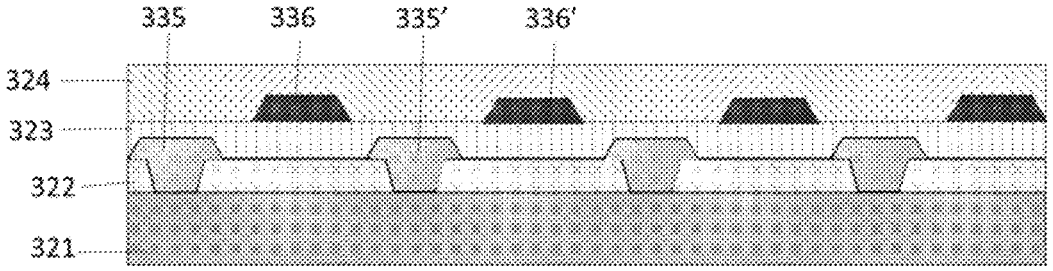
FIG. 15 is a schematic cross-sectional film layer of a crack stop area of a display panel perpendicularly to a metal signal line according to a third embodiment of the present invention.
Figure 16:
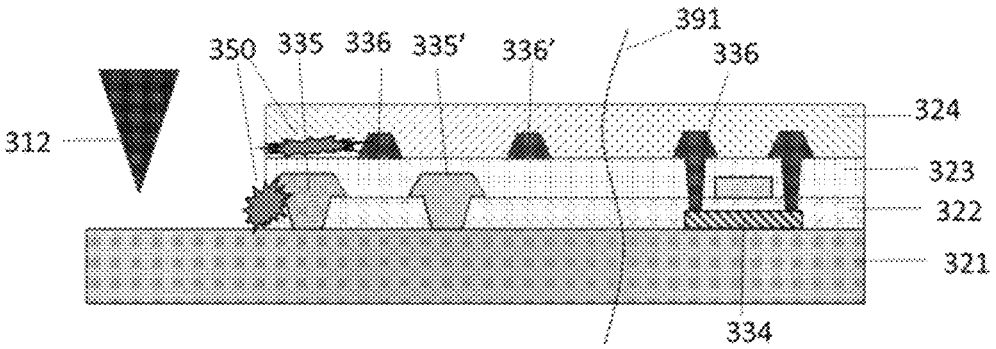
FIG. 16 is a schematic sectional view of a display panel according to a third embodiment of the present invention.

FIG. 14 to FIG. 16 are schematic sectional views of a display panel according to a third embodiment of the present invention. The third embodiment has further improvements based on the second embodiment. A schematic plan view of a display panel according to a third embodiment can refer to FIG. 8 to FIG. 10. The same the first metal layer 335, 335' and the second metal layer 336, 336' are arranged in staggered patterns, respectively, not further described herein.

As shown in FIG. 14, a display panel includes a substrate 321 and sequentially stacked as well as including a first insulating layer 322, a first metal layer 335, 335', a second insulating layer 323, a second metal layer 336, 336', and a planarization layer 324 sequentially stacked on the substrate 321. The first metal layer forms the staggered first metal blocks 335 and first metal blocks 335', and the second metal layer forms the staggered second metal blocks 336 and second metal blocks 336'. Through the through holes disposed on the second insulating layer 323, the second metal blocks 336 are connected to the two adjacent first metal blocks 335 parallel to the metal signal line (201 in FIG. 10) to form the metal signal line; the second metal blocks 336' are connected to the two adjacent first metal blocks 335' parallel to the metal signal line to form the metal signal line.

As shown in FIG. 15, in the direction perpendicularly to the metal signal line (201 in FIG. 10), the first metal blocks 335 (335') and the second metal blocks 336 (336') are staggered. The first metal blocks 335 are adjacent and staggered to the first metal blocks 335', and the second metal blocks 336 are adjacent and staggered to the second metal blocks 336'.

The present embodiment differs from the above second embodiment in that: the first metal layer 335, 335' is directly disposed on the substrate 321 through the through holes, the film layers condition is consistent as the cutting channel 312 nearby; when the cracks 350 are generated in the first insulating layer 322 during cutting the display panel, the first metal layer 335, 335' can also block the cracks 350 extend, which improves the crack stop effect of the display panel.

FIG. 16 is a schematic sectional view of a display panel according to a third embodiment of the present invention. With FIG. 1, the left side of a boundary 391 is the crack stop area 011, and the right side of the boundary 391 is a functional area of the display panel [including a GOA (Gate on Array) area and the display area 010]. In the display area, a semiconductor active layer 334 is disposed on the substrate 321; gate electrodes are formed after patterning the first metal layer; and source drain electrodes are formed after patterning the second metal layer. When the cracks 350 are generated during the display panel being cut along the cutting channel 312, the first metal blocks 335 and the first metal blocks 335' block the cracks 350 extend toward the display area. Meanwhile, the second metal blocks 336 and the second metal blocks 336' also block the cracks 350 extend toward the display area. By utilizing the staggered arrangement, the extension paths of the cracks 350 greatly increase, which greatly reduces the probability that the cracks 350 extend toward the display area.

A crack monitoring method of a display panel according to a third embodiment of the present invention is same as the crack monitoring method according to the above first embodiment. The embodiment can be found in the description of the above first embodiment, not further described herein.

In summary, in a display panel of the present invention, by disposing a crack stop area on the inner side of a cutting channel of the display panel and surrounding a display area, preparing a metal signal line formed with two metal layers in the crack stop area, and designing a structure and an arrangement of the two metal layers, the metal signal line can not only block cracks generated extend toward the display area during cutting the display panel but also monitor anomaly cracks in the crack stop area timely by connecting a monitoring circuit of the display panel; furthermore, the present invention is conducive to achieve narrowing the frame of the display panel.

In summary, although the above disclosed embodiments of the present invention in a preferred, but the above-described preferred embodiments are not intended to limit the invention, those of ordinary skill in the art, without departing from the spirit and scope of the present invention, can make various kinds of alterations and modifications, and the scope of the invention defined by the claims in the scope of equivalents.

What is claimed is:

1. A display panel, comprising a display area and a crack stop area surrounding the display area, a cutting channel disposed on a periphery of the crack stop area;

wherein the display panel comprises a monitoring circuit, and the monitoring circuit is used for monitoring cracks generated in the cutting channel when the cutting is proceeded;

and wherein a metal signal line is disposed in the crack stop area surrounding the display area and is electrically connected to the monitoring circuit; a shape of an orthogonal projection of the metal signal line on the display panel is curved, the metal signal line comprises a first metal layer and a second metal layer electrically connected to the first metal layer through a plurality of through holes, the first metal layer and/or the second metal layer are used for blocking the cracks generated extend toward the display area during cutting the display panel.

2. The display panel according to claim 1, wherein the first metal layer comprises a plurality of first metal blocks spaced at an interval, the second metal layer comprises a plurality of second metal blocks spaced at an interval, and both the first metal blocks and the second metal blocks are disposed surrounding the display area and along the crack stop area.

3. The display panel according to claim 2, wherein the first metal blocks of two adjacent columns/rows are staggered, and the interval between the two adjacent first metal blocks is less than a length of the first metal block; the second metal blocks are distributed in an array.

4. The display panel according to claim 3, wherein each of the second metal blocks is connected to two adjacent and staggered the first metal blocks; the second metal blocks in the same column/row form a metal signal line by being electrically connected to the first metal blocks of two adjacent columns/rows through the through holes.

5. The display panel according to claim 3, wherein both shapes of the first metal blocks and the second metal blocks are rectangular, and the first metal blocks and the second metal blocks are arranged in a stripe distribution or a block distribution.

6. The display panel according to claim 2, wherein the first metal blocks of two adjacent columns/rows are staggered, and the interval between the two adjacent first metal blocks is less than a length of the first metal block; and wherein the second metal blocks of two adjacent columns/rows are staggered, and the interval between two adjacent second metal blocks is less than a length of the second metal block.

7. The display panel according to claim 6, wherein the second metal block is disposed at the corresponding interval between the two adjacent first metal blocks to make the second metal blocks in a column/row connect the corresponding first metal blocks in a column/row through the through holes and form the metal signal line.

8. The display panel according to claim 6, wherein shapes of both the first metal blocks and the second metal blocks are U-shaped, and the directions of the U-shaped openings of the first metal blocks and the second metal blocks are opposite to make an orthogonal projection shape of the metal signal line on the display panel is curved.

9. The display panel according to claim 1, wherein the metal signal line is electrically connected to the monitoring circuit through a metal wire trace, the metal signal line is used for receiving a constant voltage high/low level signal; the monitoring circuit is used for monitoring the constant voltage high/low level signal through the metal signal line, wherein monitoring results of the constant voltage high/low level signal from the monitoring circuit correspond to determine whether a crack is anomaly occurred in the cutting channel.

10. The display panel according to claim 9, wherein during the cutting process of the display panel, no crack is anomaly occurred in the cutting channel when the monitoring circuit detects the constant voltage high/low level signal continuously; and wherein otherwise, the crack is anomaly occurred in the cutting channel.

11. A display panel, comprising a display area and a crack stop area surrounding the display area, a cutting channel disposed on a periphery of the crack stop area;

wherein the display panel comprises a monitoring circuit, and the monitoring circuit is used for monitoring cracks generated in the cutting channel when the cutting is proceeded;

and wherein a metal signal line is disposed in the crack stop area surrounding the display area and is electrically connected to the monitoring circuit, the metal signal line comprises a first metal layer and a second metal layer electrically connected to the first metal layer through a plurality of through holes, the first metal layer and/or the second metal layer are used for blocking the cracks generated extend toward the display area during cutting the display panel.

12. The display panel according to claim 11, wherein the first metal layer comprises a plurality of first metal blocks spaced at an interval, the second metal layer comprises a plurality of second metal blocks spaced at an interval, and both the first metal blocks and the second metal blocks are disposed surrounding the display area and along the crack stop area.

13. The display panel according to claim 12, wherein the first metal blocks of two adjacent columns/rows are staggered, and the interval between the two adjacent first metal blocks is less than a length of the first metal block; the second metal blocks are distributed in an array.

14. The display panel according to claim 13, wherein each of the second metal blocks is connected to two adjacent and staggered the first metal blocks; the second metal blocks in the same column/row form a metal signal line by being electrically connected to the first metal blocks of two adjacent columns/rows through the through holes.

15. The display panel according to claim 13, wherein both shapes of the first metal blocks and the second metal blocks are rectangular, and the first metal blocks and the second metal blocks are arranged in a stripe distribution or a block distribution.

16. The display panel according to claim 12, wherein the first metal blocks of two adjacent columns/rows are staggered, and the interval between the two adjacent first metal blocks is less than a length of the first metal block; and wherein the second metal blocks of two adjacent columns/rows are staggered, and the interval between two adjacent second metal blocks is less than a length of the second metal block.

17. The display panel according to claim 16, wherein the second metal block is disposed at the corresponding interval between the two adjacent first metal blocks to make the second metal blocks in a column/row connect the corresponding first metal blocks in a column/row through the through holes and form the metal signal line.

18. The display panel according to claim 16, wherein shapes of both the first metal blocks and the second metal blocks are U-shaped, and the directions of the U-shaped openings of the first metal blocks and the second metal blocks are opposite.

19. The display panel according to claim 11, wherein the metal signal line is electrically connected to the monitoring circuit through a metal wire trace, the metal signal line is used for receiving a constant voltage high/low level signal, the monitoring circuit is used for monitoring the constant voltage high/low level signal through the metal signal line, wherein monitoring results of the constant voltage high/low level signal from the monitoring circuit correspond to determine whether a crack is anomaly occurred in the cutting channel.

20. The display panel according to claim 19, wherein during the cutting process of the display panel, no crack is anomaly occurred in the cutting channel when the monitoring circuit detects the constant voltage high/low level signal continuously; and wherein otherwise, the crack is anomaly occurred in the cutting channel.

* * * * *